US008585834B2

(12) United States Patent
Rodzewich et al.

(10) Patent No.: US 8,585,834 B2
(45) Date of Patent: Nov. 19, 2013

(54) RINSABLE METAL PRETREATMENT METHODS AND COMPOSITIONS

(76) Inventors: Edward A. Rodzewich, Flourtown, PA (US); Jeffrey I. Melzer, Lansdale, PA (US); Philip D. Deck, Glenside, PA (US); Donald W. Whisenhunt, Jr., Niskayuna, NY (US); William S. Carey, Wallingford, PA (US); David B. Engel, Clifton Park, NY (US); Bret Chisholm, Clifton Park, NY (US); Christopher M. Carter, Schenectady, NY (US)

( * ) Notice: Subject to any disclaimer, the term of this patent is extended or adjusted under 35 U.S.C. 154(b) by 1062 days.

(21) Appl. No.: 12/157,434

(22) Filed: Jun. 10, 2008

(65) Prior Publication Data

US 2008/0245444 A1 Oct. 9, 2008

Related U.S. Application Data

(63) Continuation of application No. 11/034,416, filed on Jan. 12, 2005, now abandoned.

(51) Int. Cl.
*C23C 10/00* (2006.01)
*C23C 22/48* (2006.01)

(52) U.S. Cl.
USPC ..... 148/247; 148/253

(58) Field of Classification Search
USPC ..... 148/253, 247
See application file for complete search history.

(56) References Cited

U.S. PATENT DOCUMENTS

| | | | | |
|---|---|---|---|---|
| 4,917,737 | A | 4/1990 | Carey et al. | |
| 5,380,374 | A | 1/1995 | Tomlinson | |
| 5,441,580 | A | 8/1995 | Tomlinson | |
| 6,203,854 | B1 | 3/2001 | Affinito | |
| 6,585,933 | B1 * | 7/2003 | Ehrhardt et al. | 422/16 |
| 2003/0196728 | A1 * | 10/2003 | Nishimura et al. | 148/253 |
| 2004/0094235 | A1 | 5/2004 | Rodzewich et al. | |

FOREIGN PATENT DOCUMENTS

| | | |
|---|---|---|
| CN | 1131971 | 8/1994 |
| EP | 0437722 | 7/1991 |
| EP | 1206977 | 5/2002 |
| GB | 2309972 | 8/1997 |
| JP | 2003313679 | 11/2003 |
| WO | 94/21842 | 9/1994 |
| WO | 95/05496 | 2/1995 |
| WO | 01/32952 | 5/2001 |
| WO | 01/46495 | 6/2001 |

OTHER PUBLICATIONS

Advisory Action in U.S. Appl. No. 11/034,416 dated May 16, 2008.
Final Rejection in U.S. Appl. No. 11/034,416 dated Mar. 17, 2008.
Non-Final Rejection in U.S. Appl. No. 11/034,416 dated Oct. 26, 2007.
Requirement for Restriction/Election in U.S. Appl. No. 11/034,416 dated Aug. 30, 2007.
Standard Practice for Operating Salt Spray (FOG) Apparaturs, ASTM International, Oct. 1, 2003, pp. 1-11, B-117-03, West Conshohocken, PA.
Standard Test Method for Evaluation of Painted or Coated Specimens Subjected to Corrosive Environments, ASTM International, 2000, pp. 1-3, D-1654-92, West Conshohocken, PA.

* cited by examiner

*Primary Examiner* — Weiping Zhu
(74) *Attorney, Agent, or Firm* — McAndrews, Held & Malloy Ltd.

(57) ABSTRACT

Chromate-free and metal phosphate free treatments and compositions for applying a conversion or passivation coating for metals, more particularly, steel, zinc coated steel, and aluminum surfaces. The methods of the invention comprise contacting the requisite metal surface with a treatment composition comprising a member or members comprising one or more Group IV B elements, fluoride, and phosphonic acid or phosphonate. Optionally, a silane may be added as a treatment component.

11 Claims, No Drawings

RINSABLE METAL PRETREATMENT METHODS AND COMPOSITIONS

CROSS-REFERENCE TO RELATED APPLICATION

This application is a continuation of U.S. patent application Ser. No. 11/034,416 filed Jan. 12, 2005.

FIELD OF INVENTION

The present invention relates to non-chrome containing coatings for metals. More particularly, the present invention relates to rinsable, non-chromate, non-metal phosphate coatings for steel, zinc coated steel, and aluminum surfaces to improve the adhesion of siccative coatings to the surface and provide enhanced corrosion protection.

BACKGROUND OF THE INVENTION

It is well known to those skilled in the art to employ a chromate or phosphate conversion or passivation coating on the surface of metals to impart improved corrosion resistance of bare and painted metal, improve adhesion of coatings, and for aesthetic purposes. For example, see *Corrosion*, L. L. Sheir, R. A. Jarman, G. T. Burstein, Eds. (3rd Edition, Butterworth-Heinemann Ltd, Oxford, 1994), Volume 2, chapter 15.3.

Growing concerns exist regarding the toxicity profile of chromium and the pollution effect of chromates, phosphates and other heavy metals discharged into rivers and waterways by such processes. Because of the high solubility and the strongly oxidizing character of hexavalent chromium ions, conventional chromate conversion processes require extensive water treatment procedures to control their discharge. Phosphate processes also require waste treatment procedures prior to discharge. In addition, the disposal of the solid sludge from such waste treatment procedures is a significant problem.

Accordingly, there is a need in the art to provide an effective non-chromate, non metal phosphate, or reduced phosphate based treatment to inhibit metal surface corrosion and enhance adhesion of paint or other coatings that may be applied to the surface.

SUMMARY OF THE INVENTION

Acidic, aqueous solutions or dispersions are provided for contact with the requisite metal surfaces such as steel, zinc coated steel, and aluminum surfaces. The solutions and dispersions are chromate free and provide enhanced corrosion protection and adherence of siccative coatings on the metal surface. These siccative coatings typically include paints, lacquers, inks, varnishes, resins, etc.

The methods of the invention comprise contacting the requisite metal surface with an effective amount of an acidic aqueous composition or dispersion to enhance corrosion protection and adherence of siccative coatings. The chromate and inorganic phosphate free composition or dispersion comprise (a) a material or materials including a Group IV B element; (b) a fluoride source; and (c) phosphonic acid or phosphonate. After contact of the surface with the above composition or dispersion, the coating may be rinsed and dried in place. The surface is then ready for application of a paint, lacquer, varnish, resin, or other siccative coating thereto.

DETAILED DESCRIPTION

The inventors have found that an improved, non-chromate conversion or passivation coating can be provided on metal surfaces, particularly steel surfaces, zinc coated steel and aluminum surfaces. The acidic aqueous compositions or dispersions comprise (a) a material or materials comprising one or more elements selected from the Group IV B elements as set forth in the CAS version of the Periodic Table of Elements. Such elements comprise Zr, Ti, and Hf. Mixtures of these elements may be included. Zr and Ti containing materials are preferred. Exemplary Zr sources are adapted to provide Zr anions in an acidic medium and include a soluble fluozirconate, zirconium fluoride ($ZrF_4$), or water soluble zirconium salt such as zirconium nitrate or sulfate. Further, the zirconium source can comprise an ammonium or alkali zirconium salt. Zirconium oxides and Zr metal itself may be used provided it ionizes to Zr anion in an acidic medium. Most preferably, the Zr source comprises fluozirconic acid, $H_2ZrF_6$. Additionally, organic Zr containing compounds may be utilized provided they liberate Zr in the acidic aqueous medium.

The Group IV B element may also comprise Ti. The preferred Ti source is $H_2TiF_6$, but titanium fluorides such as $TiF_3$ and $TiF_4$ may also be mentioned. Nitrate, sulfate, ammonium or alkali titanium salts can also be used as well as Ti metal itself. Additionally, organic Ti compounds can be used if they liberate Ti in the acidic medium. Preliminary tests have included use of Ti(iv) isopropoxide as a Ti source component especially if it is reacted with an acidic solution such as $H_2ZrF_6$.

The fluoride source (b) that is used as a component of the acidic treatment or composition may most preferably be the same fluozironic or fluotitiantic acid that may be employed to provide the Ti and/or Zr. It is most preferred that the treatment comprise $H_2ZrF_6$ and $H_2TiF_6$ which combination will adequately serve as a source of the Zr, Ti, and fluoride. Other suitable F sources include hydrofluoridic acid and salts thereof, alkali metal bifluorides, $H_2SiF_6$ and $HBF_4$. Again, the source must be capable of liberating F in the medium. Most preferably, the combined Zr, Ti, and F sources liberate fluotitanate and fluozinconate, i.e., $(TiF_6)^{-2}$ and $(ZrF_6)^{-2}$, in the medium.

The desirable fluoride concentration is that which will combine with the Zr and Ti to form a soluble complex therewith, for example, a fluozirconate and fluotitanate. Generally, at least about 4 moles of fluoride is provided per mole of Zr and Ti present. Zirconium and titanium may be present in the treatment medium in amounts up to slightly greater that their solubility limits.

With regard to component (c) of the formulation, the phosphonic acids and phosphonates, these may be mentioned as including any compounds having the formula

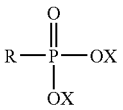

(I)

wherein X is H or a cation; R is any organic moiety including alkyl, cycloalkyl, substituted and unsubstituted N and/or P containing heterocyles, aryl, substituted aryl including halogenated aryl and alkyl substituted aryl, substituted alkyl such as aminoalkyl, carboxyalkyl, phosphonoalkyl, alkylimino, hydroxyalkyl, silane substituted alkyl, etc.

The phosphonate may more particularly be selected from phosphonic acids and phosphonates having formulas as per II, III, and IV, as follows whereas phosphonate (II) has the formula:

(II)

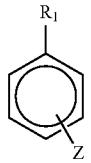

wherein $R_1$ is $PO_3X_2$ or $R_2PO_3X_2$, wherein $X_2$ is independently chosen from H or a cation, and $R_2$ is a $C_1$-$C_5$ alkylene, preferably methylene. Z is a member selected from H, halo, $C_1$-$C_5$ alkyl, $NO_2$, and COOH. Preferably Z is located in the para position. Exemplary members of this group include 4-bromobenzylphosphonic acid, 4-tertbutylbenzylphosphonic acid, phenylphosphonic acid, 4-hydroxybenzylphosphonic acid, 4-nitrobenzylphosphonic acid, 4-methylbenzylphosphonic acid, 4-carboxybenzylphosphonic acid, and 4-bromobenzyl phosphonate ethyl ester.

Phosphonates having the formula (III) may also be mentioned (III)

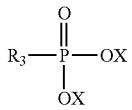

wherein X is as defined above in the formulation (I) and $R_3$ is $C_1$-$C_5$ alkyl, $C_1$-$C_5$ carboxyalkyl, $C_1$-$C_5$ phosphonoalkyl, $C_1$-$C_5$ siloxyalkyl, $C_1$-$C_5$ iminoalkyl, and $C_1$-$C_5$ phosphonoiminoalkyl. Exemplary members of this group include 2-carboxyethylphosphonic acid, trihydroxysilylpropylmethyl phosphonate, 1,2, -diethylenediphosphonic acid, iminobis(methylphosphonic acid) and tert-butylphosphonic acid.

The phosphonate can also be chosen from formula IV.

(IV)

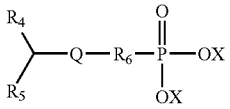

wherein X is as defined above in formula I. $R_4$ and $R_5$ are independently chosen from hydrogen, $C_1$-$C_5$ alkyl, $C_1$-$C_5$ hydroxyalkyl, and $C_1$-$C_5$ phosphonoalkyl, with the proviso that $R_4$ and $R_5$ may, together as covalently bonded, form a cyclic structure, $R_6$ may or may not be present and, when present, is chosen from $C_1$-$C_5$ alkylene; Q is N or N oxide (i.e., $N{=}O^+$). Exemplary members of this Group IV include phosphonic acid [[(2-hydroxyethyl)imino]bis(methylene) bis-, N oxide referenced to herein as—linear EBO—CAS 137006-87-2; and [tetrahydro-2-hydroxy-4H-1,4,2-oxaza phosphorin-4-yl)methyl]-N,P-dioxide CAS 133839-05-01—referred to herein as cyclic EBO.

Preferably both linear EBO and cyclic EBO are present at once in the form of mixed solution. Based upon preliminary data, a mixture of linear EBO and cyclic EBO is preferred for use. These phosphonates may be prepared via the following preparatory route.

Phosphonate Preparation Linear EBO and Cyclic EBO Mixture (Group IV)

To a glass reactor vessel equipped with a mechanical stirrer, thermometer, overhead condenser, and addition port are charged 70% aqueous phosphorous acid (2.00 mole) and 32% aqueous hydrochloric acid (0.33 mole). 90% actives paraformaldehyde (2.00 mole) is then added drop wise to the acid solution with mixing. After addition, the reactor contents are heated to 85±2° C. under a nitrogen sparge and held for 30 minutes. The nitrogen sparge is then switched to a nitrogen blanket and 99% monoethanolamine (1.00 mole) is charged drop wise over a 1 to 2-hour period while maintaining a batch temperature of 85±2° C. After addition, the batch is heated to 93±2° C. and held for 8 hours. After the hold, the batch is cooled and adjusted to pH 9-10 by addition of 50% aqueous sodium hydroxide (3.73 mole). The batch temperature is then adjusted to 40±2° C. and 35% aqueous hydrogen peroxide (1.07 mole) is charged drop wise over approximately a 1-hour period with cooling to maintain the batch temperature between 38-52° C. After addition, the batch is held at 50±2° C. for 2 hours. The batch is then cooled to room temperature and collected. During the cool down, 50% aqueous gluconic acid (0.005 mole) is charged to the batch.

The product as produced is characterized by 13P NMR as a nominal 1:1 molar ratio of the sodium salts of Linear EBO and Cyclic EBO and is referred collectively hereinafter as EBO. The material is also composed of traces of the sodium salts of residual phosphorous acid, oxidized byproduct phosphoric acid, and byproduct methylenediphosphonic acid. It is a preferred embodiment of the invention to utilize the product as produced without any purification.

Other exemplary phosphonates may be prepared as follows:

Phosphonate Preparation:
4-Bromobenzylphosphonic Acid (BBPA) (Group II)

4-bromobenzyl bromide (4.4 g, 0.017 mol) was combined with the triethylphosphonate (3.5 g., 3.5 mL, 0.021 mol) and heated at 130° C. for 12 hours. The reaction was cooled to room temperature and stored in the dark. The intermediate was dissolved in 20 mL MeCN and treated with solid KI (8.7 g, 0.0525 mol) followed by $Me_3SiCl$ (5.63 g, 6.6 mL, 0.105 mol). The reaction was stirred for 6 hours at 60° C. and cooled to room temperature. The solid KCl was filtered, and the residue was evaporated to dryness. The residue was taken in 10 mL distilled water. The amber oil precipitated in 5 minutes. The solid was fileted and washed with cold hexanes. This gave 3.02 g (70%) of the product as a white-gray powder.

Phosphonate Preparation:
4-tert-Butylbenzylphosphonic Acid (TBBPA) (Group II)

4-tert-butylbenzyl bromide (0.91 g, 4.0 mmol) was combined with the triethylphosphonate (0.798 g, 0.836 mL, 4.8 mmol) and heated at 130° C. for 24 hours. The reaction was cooled to room temperature and stored in the dark. The intermediate was then dissolved in 5 mL MeCN and treated with solid KI (1.92 g, 11.62 mmol) followed by $Me_3SiCl$ (1.27 g, 1.47 mL, 11.62 mmol). The reaction was stirred for 12 hours at 60° C. and cooled to room temperature. The solid KCl was filtered, and the residue was evaporated to dryness. The residue was taken in 5 mL distilled water. The amber oil precipitated in 5 minutes. The solid was filtered and washed with cold hexanes. This gave 0.80 g (90%) of the product as a white-amber powder.

The other substituted benzyl phosphonates of class II are similarly prepared. That is, the corresponding benzyl bromide is used as the starting reactant and then reacted with triethylphosphonate to form the desired substituted benzylphosphonate ester. The ester may be converted to the acid form via conventional techniques or used in its so produced ester form.

All of the other specifically enumerated phosophonates are commercially available.

Additionally, a silane (d) may be included in the acidic treatment composition. Representative silanes include, but are not limited to, alkoxysilane, aminosilane, ureidosilane, glycidoxysilane, or mixtures thereof. Preferred alkoxysilanes and aminosilanes are taught in U.S. Pat. No. 6,203,854. At present, most preferred is ureidopropyltrimethoxy silane available from GE Silicones—OSI under the designation Silquest A 1524.

Preferred acidic, aqueous compositions in accordance with the invention are chromate free and include:

a1) a zirconium source present in an amount of from about 0.01 wt % to about 10 wt % above its solubility limit;

a2) a titanium source present in an amount of from about 0.01 wt % to about 10 wt % above its solubility limit;

b) a fluoride source wherein fluoride is present in a molar excess relative to the total moles of Zr and Ti present, preferably in a molar excess of at least about four times the total molar amount of Zr and Ti present;

c) phosphonic acid or phosphonate present in an amount of about 0.01-50 wt %; and optionally d) a silane.

The remainder of the composition comprises water and pH adjustment agent to regulate the pH within the range of about 0.5-6. The weight of the acidic aqueous composition is 100 wt %.

In a more specific aspect of the invention, the acidic, aqueous compositions comprise:

1) $H_2ZrF_6$ in an amount of 0.01-40 wt %

2) $H_2TiF_6$ in an amount of 0.01-40 wt %;

3) phosphonic acid or phosphonate in an amount of about 0.01-50 wt %;

4) silane in an amount of about 0.00-20 wt %; remainder water and pH adjustment agent. The composition, in total, including water is 100 wt %.

Preferred compositions include

1) $H_2ZrF_6$ in an amount of about 0.01-40 wt %

2) $H_2TiF_6$ in an amount of about 0.01-40 wt %

3) a phosphonic acid or phosphonate selected from the group of (i) Linear EBO and (ii) Cyclic EBO and mixtures of (i) and (ii). These phosphonates are present in a combined amount of about 0.01-50 wt %. The remainder of the composition is optional silane (4) in an amount of about 0.00-20 wt %, water and pH adjustment agent.

The requisite metal surface may be contacted by the treatment in spray, immersion, or other application forms. The treatment may be rinsed and dried with the thus prepared metal surface then ready for application of a siccative coating thereto.

The acidic aqueous solution or dispersion in accordance with the invention is applied to the metal surface to result in a coating weight of greater than about 1 milligram per square foot to the treated surface with a weight of about 2-500 milligrams per square foot being more preferred. For use in commercial applications, working solutions comprising about 3-100 wt %, preferably 10-100 wt % concentration, of the above formulations may be used to contact the desired metal surfaces.

As is customary for commercial applications, additives can be included in the formulation to facilitate formation of the conversion coating. Oxidizing agents such as nitrate, nitrites, chlorates, bromates, and nitro aromatic compounds can be added to speed up and maintain coating formation. Inorganic or organic acids and bases can be added to maintain pH of the working bath.

EXAMPLES

The invention will now be described in conjunction with the following comparative example and working examples. The working examples are to be regarded as being illustrative of certain embodiments of the invention but should not be viewed to restrict the scope of the same.

Comparative Example 1

In order to establish baseline performance, the titanium and zirconium components were evaluated without any additional additives.

General Pretreatment Process:

ACT Laboratories cold rolled steel panels were used.

Clean with 2% Betz Kleen 132 (commercially available from GE Water & Process Technologies) 140° F., 90 second spray Rinse—tap water spray applied for 30 seconds Pretreat—immersion for 2 minutes at 140° F.

Rinse—De-ionized water flooding rinse for 30 seconds

Dry—hot air gun

Formulation:

| Components | Grams/L |
|---|---|
| $Ti(iOPr)_4$ | 0.12 |
| $H_2ZrF_6$ (45%) | 1.5 |
| Water | Remaining |

After pretreatment, panels were painted with a single coat polyester paint system, White Polycron III (AG452W3223), from PPG Industries. The paint was applied and cured per the manufacturer's specifications. After painting, the panels were subjected to Neutral Salt Spray tests (NSS) according to ASTM B-117 at 168 hours and rated for creep from the scribe in accordance with ASTM D-1654 (Table 1).

TABLE 1

| Neutral Salt Spray Performance Creep from scribe | |
|---|---|
| 168 Hours Exposure | 336 Hours Exposure |
| 3.4 +/− 1.5 millimeters | 6.7 +/− 1.7 millimeters |

Example 1

The following formulations were evaluated to examine the effect of phosphonate addition to the base titanium+zirconium formulation Panels were processed and painted as in Comparative Example 1. Test results are contained in Table 2.

| Grams/Liter | A-1 | A-2 | A-3 | A-4 | A-5 | A-6 | A-7 |
|---|---|---|---|---|---|---|---|
| $Ti(ioPr)_4$ | 0.12 | 0.12 | 0.12 | 0.12 | 0.12 | 0.12 | 0.12 |
| $H_2ZrF_6$ | 1.5 | 1.5 | 1.5 | 1.5 | 1.5 | 1.5 | 1.5 |
| EBO | 0.25 | | 0.25 | 0.25 | 0.25 | | |
| BBPA | 0.5 | | 0.3 | 1.0 | | | |
| CEPA | | 0.30 | | | | 0.5 | 1.0 |
| THSPMP | | | | | 0.5 | | |
| Water | Remainder | Remainder | Remainder | Remainder | Remainder | Remainder | Remainder |

| Grams/Liter | A-8 | A-9 | A-10 | | C-1 (comparative) |
|---|---|---|---|---|---|
| $Ti(ioPr)_4$ | 0.12 | 0.12 | 0.12 | TEOS | 5.0 |
| $H_2ZrF_6$ | 1.5 | 1.5 | 1.5 | GPTMS | 7.5 |
| EBO | | | 0.25 | UPTMS | 7.5 |
| BBPA | | | | EDPA | 0.5 |
| CEPA | | | | Water | Remainder |
| THSPMP | | | | | 0.5 |
| TBBPA | 0.3 | 0.5 | | | |
| Water | Remainder | Remainder | Remainder | | |

Abbreviations used:
$Ti(ioPr)_4$ = Titanium Isopropoxide
EBO = mixed linear and cyclic EBOs
Linear EBO = Phosphonic acid [[(2-hydroxyethyl)imino]bis(methylene)] bis-, N-oxide
Cyclic EBO = Phosphonic acid [(tetrahydro-2-hydroxy-4H-1,4,2-oxazaphosphorin-4-yl)methyl]-N,P-dioxide
BBPA = 4-bromobenzylphosphonic acid
CEPA = 2-carboxyethylphosphonic acid
TEOS = tetraethylorthosilicate
GPTMS = glycidoxypropyltrimethoxy silane
UPTMS = ureidopropyltrimethoxy silane
TBBPA = 4-tertbutylbenzenephosphonic acid
EDPA = 1,2-ethylenediphosphonic acid
THSPMP = 3-trihydroxysilyl propylmethylphosphonate

TABLE 2

| Formulation | Average Mean Creepage -millimeters. 168 hours | 336 hours |
|---|---|---|
| A-1 | 0.3 | 1.2 |
| A-2 | 1.0 | 5.4 |
| C-1 | 5.0 | 9.0 |
| A-3 | 0.6 | 1.0 |
| A-4 | 0.6 | 1.9 |
| A-5 | 0.8 | 1.4 |
| A-6 | 0.7 | 2.8 |
| A-7 | 1.2 | 4.9 |
| A-8 | 1.7 | 2.4 |
| A-9 | 1.3 | 3.3 |
| A-10 | 3.2 | NA |

TABLE 2-continued

| Formulation | Average Mean Creepage -millimeters. 168 hours | 336 hours |
|---|---|---|
| B 958/P60 | 1.5 | |
| B 1000/P60 | 1.1 | |
| B958/P95 | 1.4 | |

[B958/P60; B1000/P60; and B958/P95 panels were purchased from ACT Laboratories, Inc.]

Example 2

The following additional formulations were prepared and painted as in Comparative Example 1.

| Grams/Liter | X-1 | X-2 | X-3 | X-4 | X-5 | X-6 | X-7 |
|---|---|---|---|---|---|---|---|
| $Ti(ioPr)_4$ | 0.12 | 0.24 | 0.12 | 0.24 | 0.12 | 0.24 | 0.12 |
| $H_2ZrF_6$ (45%) | 1.5 | 3.0 | 1.5 | 3.0 | 1.5 | 3.0 | 1.5 |
| EBO | | | 0.25 | 0.25 | 0.25 | 0.51 | 2.53 |
| BBPA | 0.07 | | 0.3 | | | | |
| PPA | | 0.131 | 0.70 | 1.4 | | | 1.0 |
| Water | Remainder | Remainder | Remainder | Remainder | Remainder | Remainder | Remainder |

| Grams/Liter | X-8 | X-9 | X-10 | X-11 | X-12 | X-14 | X-15 |
|---|---|---|---|---|---|---|---|
| $Ti(ioPr)_4$ | 0.24 | 0.12 | 0.24 | 0.12 | 0.23 | 0.12 | 0.24 |
| $H_2ZrF_6$ (45%) | 3.0 | 1.5 | 3.0 | 1.5 | 2.9 | 1.5 | 3.0 |
| EBO | 5.0 | | | | | | |
| BBPA | | 0.07 | 0.13 | 0.62 | | | |
| TBBPA | | | | | 2.17 | | |
| Water | Remainder | Remainder | Remainder | Remainder | Remainder | Remainder | Remainder |

Abbreviations used:
Same as in Example 2, additionally PPA = phenylphosphonic acid.

Neutral Spray Salt Tests in accordance with ASTM B-117 and D-1654 were conducted as reported in Example 1. Results are reported in Table 3.

TABLE 3

| Formulation | Average Mean Creepage -millimeters. 168 hours | 336 hours |
|---|---|---|
| X-1 | 1.2 | 3.0 |
| X-2 | 2.6 | 6.3 |
| X-3 | 3.3 | 7.5 |
| X-4 | 5.0 | 10 |
| X-5 | 0.9 | 2.6 |
| X-6 | 1.1 | 2.1 |
| X-7 | 3.1 | 8.75 |
| X-8 | 4.9 | 10.0 |
| X-9 | 1.4 | 2.7 |
| X-10 | 1.7 | 3.8 |
| X-11 | 3.3 | 8.7 |
| X-12 | 10.0 | NA |
| X-14 | 1.0 | 3.9 |
| X-15 | 1.5 | 3.1 |

Example 3

Additional phosphonates were evaluated as in Example 1. A base formulation of Ti and Zr components was prepared as follows:

Base Formulation:

| Components | Grams/L |
|---|---|
| $Ti(iOPr)_4$ | 0.12 |
| $H_2ZrF_6$ (45%) | 1.5 |
| Water | Remaining |

Neutral salt spray results are reported in Table 4.

TABLE 4

| Phosphonate | Phosphonate Level (grams/L) | 168 hours NSS (mm creep) | 336 hours NSS (mm creep) |
|---|---|---|---|
| 2-Carboxyethylphosphonic Acid | 0.5 | 0.7 | 2.8 |
| 4-Bromobenzylphosphonic Acid | 0.5 | 0.3 | 1.2 |
| 4-tertbutylbenzenephosphonic Acid | 0.5 | 1.7 | 2.3 |
| 3-Trhihydroxysilylpropylmethyl-phosphonate | 0.5 | 0.8 | 1.4 |
| 4-hydroxybenzylphosphonic acid | 0.25 | 0.7 | 1.0 |
| 4-nitrobenzylphosphonic acid | 0.25 | 1.1 | 1.4 |
| 4-methylbenzylphosphonic acid | 0.25 | 1.3 | 1.5 |
| 4-Bromobenzyl phosphonate ester | 0.25 | 0.9 | 1.4 |
| Bromophenyltrimethoxysilane | 0.5 | 0.8 | 1.4 |
| Iminobis(methylphosphonic acid) | 0.1 | 1.0 | 2.7 |
| tert-butylphosphonic Acid | 0.1 | 0.7 | 1.5 |
| EBO phosphonate | 0.25 | *1.5 +/− 0.4 | *2.5 +/− 0.6 |
| *Zinc phosphate/chrome sealed | B958/P60 | 0.91 | 1.85 |
| *Zinc phosphate/non-chrome sealed | B958/P95 | 0.95 | 1.93 |

Note -

NSS results are averages of 2 panels.

*Average of 20 panels.

Example 4

To further evaluate the performance of the invention, the following formulations were prepared and tested. Multiple baths of each composition were prepared and used so that a number of replicates could be produced. The NSS results are the average of twenty panels run through each composition. Panels were processed as in Example 1.

| Bath component | A | B |
|---|---|---|
| Fluozirconic acid (45%) | 1.5 g/L | 1.5 |
| Fluotitanic acid (60%) | 0.12 | 0.12 |
| EBO phosphonate | | 0.25 |
| 168 hour NSS creepage (mm) | 3.4 | 1.5 |
| 336 hour NSS creepage (mm) | 6.8 | 2.5 |

Example 5

In order to illustrate the use of oxidizing and pH adjustment agents the following examples were prepared.

CRS panels from ACT Laboratories were prepared by the following process sequence:

Clean for 60 s at 140° F. in an alkaline cleaner (Kleen 132)
Rinse with water for 15 s
Treat—spray application at 120° F. and 10 psi for 30
Rinse with deionized water for 10 s
Warm air dry

| Bath component | A | B | C | D | E |
|---|---|---|---|---|---|
| Fluozirconic acid (45%) | 0.75 g/L | 0.75 | 2.2 | 1.5 | 1.5 |
| Fluotitanic acid (60%) | 0.18 | 0.06 | 0.06 | 0.12 | 0.12 |
| EBO phosphonate | 0.38 | 0.38 | 0.38 | 0.25 | 0.25 |
| Boric acid | 0.30 | 0.30 | 0.30 | 0.80 | 0.20 |
| Na nitrobenzenesulfonate | 1.0 | 1.0 | 1.0 | 0.80 | 0.80 |
| Sodium nitrate | 0.70 | 0.70 | 0.70 | 0.70 | 0.70 |
| Fe (added as FeSO4•7$H_2O$) | 0.04 | 0.04 | 0.04 | 0.04 | 0.04 |
| Bath pH | 4.8 | 4.8 | 4.8 | 5.0 | 4.0 |

Panels were painted with Polycron paint and performance evaluated at 240 hour neutral salt spray exposure.

TABLE 5

| | A | B | C | D | E | *B 958/no seal |
|---|---|---|---|---|---|---|
| mm creep from scribe | 2.2 | 2.5 | 2.7 | 3.8 | 5.3 | 3.4 |

*B 958 - a zinc phosphate non-sealed pretreated panel purchased from ACT Laboratories Inc.

While the invention has been described with respect to particular embodiments, it is apparent that numerous other forms and modifications of the inventions will be obvious to those skilled in the art. The appended claims and this invention generally should be construed to cover all such obvious forms and modifications which are within the true spirit and scope of the invention.

The invention claimed is:

1. A method of coating a metal or metal alloy surface comprising contacting said surface with an effective amount of a chromate free aqueous treatment solution or dispersion comprising (a) a material or materials comprising one or more elements selected from Group IV B elements, (b) fluoride, (c) a mixed solution of linear EBO and cyclic EBO.

2. A method as recited in claim 1 wherein (a) comprises $H_2ZrF_6$ and $H_2TiF_6$.

3. A method as recited in claim 1 further comprising at least one more phosphonic acid or phosphonate.

4. A method as recited in claim 3, wherein said at least one more phosphonic acid or phosphonate (c) is selected from the group consisting of the formulas II, Ill, or IV, wherein formula II has the structure:

(II)

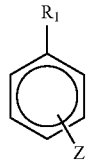

wherein $R_1$ is $PO_3X_2$ or $R_2PO_3X_2$ wherein $X_2$ is a cation or H; $R_2$ is $C_1$-$C_5$ alkylene and Z is a member selected from H, halo, $C_1$-$C_5$ alkyl, $NO_2$ and COOH; formula III has the structure:

(III)

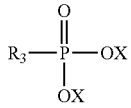

wherein X is independently chosen from a cation or H; and $R_3$ is $C_1$-$C_5$ alkyl, $C_1$-$C_5$ carboxyalkyl, $C_1$-$C_5$ 5 phosphonoalkyl, $C_1$-$C_5$ siloxyalkyl, and $C_1$-$C_5$ iminoalkyl or $C_1$-$C_5$ phosphonoimino alkyl; and (IV)

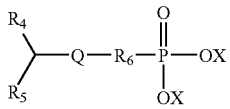

wherein X is as defined above; $R_4$ and $R_5$ are independently chosen from H, $C_1$-$C_5$ alkyl, $C_1$-$C_5$ hydroxyalkyl, $C_1$-$C_5$ phosphonoalkyl, with the proviso that $R_4$ and $R_5$ may, together as covalently linked, form a cyclic structure; $R_6$ may or may not be present, and when present is a $C_1$-$C_5$ alkylene moiety; and Q is N or N oxide$^+$.

5. A method as recited in claim 4 wherein said at least one more phosphonic acid or phosphonate (c) has the formula IV.

6. A method as recited in claim 4 wherein said at least one more phosphonic acid or phosphonate (c) has the formula (II).

7. A method as recited in claim 6 wherein said at least one more phosphonic acid and/or phosphonate (c) is a member or members selected from the group consisting of 4-bromobenzylphosphonic acid,
4-tertbutylbenzylphosphonic acid,
phenylphosphonic acid,
4-hydroxybenzylphosphonic acid,
4-nitrobenzylphosphonic acid,
4-methylbenzylphosphonic acid,
4-carboxybenzylphosphonic acid and
4-bromobenzyl phosphonate ethyl ester.

8. A method as recited in claim 4 wherein said at least one more phosphonic acid or phosphonate (c) has the formula III.

9. A method as recited in claim 8 wherein said at least one more phosphonic and/or phosphonate (c) is a member or members selected from the group consisting of 2-carboxyethylphosphonic acid,
trihydroxysilylpropyl phosphonate;
1,2,-diethylenediphosphonic acid,
iminobis(methylphosphonic acid) and
tertbutylphosphonic acid.

10. A method as recited in claim 1 further comprising at least one silane.

11. A method as recited in claim 10 wherein said at least on silane is selected from the group of alkoxysilane, aminosilane, ureidosilane, glycidoxysilane or mixtures thereof.

* * * * *